United States Patent [19]

Marie et al.

[11] Patent Number: 4,921,455

[45] Date of Patent: May 1, 1990

[54] ELECTRIC CONNECTION TERMINAL WITH BRAKED SCREW

[75] Inventors: Philipe Marie, Rouen; Pierre J. Decelle, Val De Reuil, both of France

[73] Assignee: La Telemecanique Electrique, France

[21] Appl. No.: 337,985

[22] Filed: Apr. 14, 1989

[30] Foreign Application Priority Data

Apr. 15, 1988 [FR] France ..... 88 04991

[51] Int. Cl.[5] ..... H01R 9/24

[52] U.S. Cl. ..... 439/709; 439/813

[58] Field of Search ..... 439/709, 801, 813

*Primary Examiner*—Gary F. Paumen

*Attorney, Agent, or Firm*—William A. Drucker

[57] ABSTRACT

An electric connection terminal is provided with a braked screw, in particular for a contactor apparatus. One end of the screw, which projects from the threaded hole in which it is engaged, comes into transverse contact with a resiliently deformable tongue forming part of a portion of the apparatus.

4 Claims, 1 Drawing Sheet

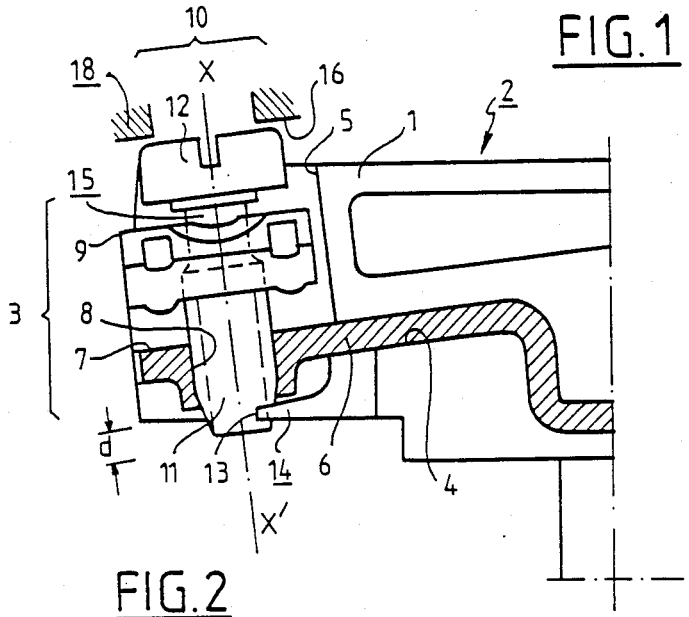
FIG.1
FIG.2
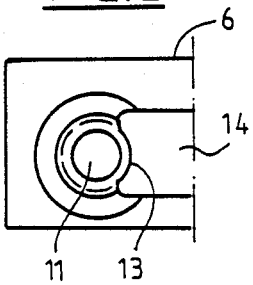
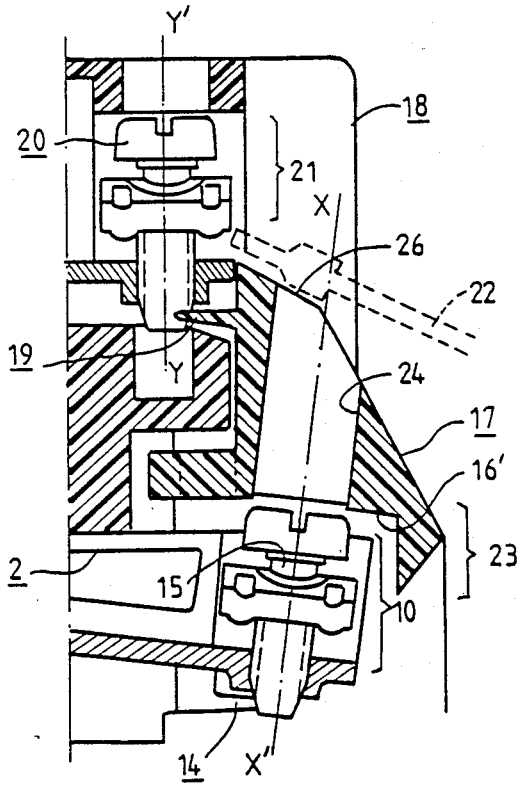
FIG.3

ELECTRIC CONNECTION TERMINAL WITH BRAKED SCREW

BACKGROUND OF THE INVENTION

1. Field of the Invention

The invention relates to a connection terminal for an electric apparatus comprising a conducting part which is associated with an insulating support and which has a tapped hole a screw which passes through a tightening stirrup and which is engaged in this hole, means being provided on the support for limiting the movement of the head in the unscrewing direction.

2. Description of the Prior Art

The very frequent use of this type of terminal, as well as the time which must be spent on clamping the conductors which they receive, have led electric equipment manufacturers to take an interest in the different problems with which the user or the maintenance staff are confronted.

In a first approach, the screws of such apparatus terminals, unprotected in the unscrewing direction, were locked at the time of their manufacture, so as to prevent accidental unscrewing thereof during transport, as well as the loss which resulted therefrom.

When it was discovered that the staff was compelled to spend a not inconsiderable time in unscrewing these screws so as to fit conductors under their tightening stirrups, at the time of wiring up, measures were then taken so that the body of the electric apparatus concerned, or the walls of this body close o the terminals, had shapes adapted for preventing these screws from falling which were partially screwed into the conducting part; this approach, which has the advantage of making already open terminals available to the user, does not however prevent untimely screwing up of the screw, which is caused by vibrations which may be met with for example during transport of apparatus thus equipped.

SUMMARY OF THE INVENTION

Consequently, the invention proposes improving a terminal of the above mentioned type so that a terminal screw partially screwed into the conducting part may be prevented from being accidentally screwed in or screwed out, while only opposing a very small resistant torque at the time when it is tightened on the conductors to be connected.

According to the invention, this object is reached because the terminal screw has a length such that, when it is in its maximum unscrewed position, an end portion opposite the head projects from the tapped hole by an amount sufficient to bring this portion in contact with a resilient transverse tongue which is directly or indirectly secured to the insulating support.

Advantageously, said tongue may belong to a coil frame of an electromagnet of a contacter and may cooperate with a terminal connecting this coil.

BRIEF DESCRIPTION OF THE DRAWINGS

The invention will be better understood from the following description and from the figures which illustrate such terminals:

in a partial sectional view in elevation in FIG. 1;

and respectively in a bottom view in FIG. 2;

FIG. 3 showing a partial section of an apparatus with two superimposed terminals.

DESCRIPTION OF THE PREFERRED EMBODIMENT

An insulating support 1, belonging for example to an electromagnet coil frame 2, which is partially shown and made from a molded plastic material, comprises an upper portion 3 in which are formed, for example, a groove 4 and a cavity such as 5 for receiving and holding a conducting part 6 of terminal 10 which is engaged and fastened therein; this part has, at one of its ends, a connection portion 7 in which a boss and a tapped hole 8 have been provided for receiving a terminal screw 15 passing further through a tightening stirrup 9, see FIG. 1.

When this bridge connector is in its open condition giving it a position sufficiently removed from the connection portion so as to be able to receive a conductor of large diameter (not shown), a threaded end portion 11, opposite head 12, projects from the tapped hole 8 by a certain amount -d-.

In this position in which the opening of the terminal is at its maximum, head 12 of the screw meets a wall 16 belonging either to the support 1 or to a subsidiary part of contactor apparatus which receives the coil.

This threaded end portion 11 is then in contact with the edge 13 of a resiliently deformable tongue 14.

This tongue, which is under transverse compression with respect to the axis XX' of the screw, may advantageously form part of the insulating support 1 and communicate in all cases to this terminal screw a slight braking torque which is sufficient to prevent it being screwed in or screwed out in the absence of conductors, see also FIG. 2.

It is clear that the presence of wall 16 of apparatus 18 normally prevents unscrewing when the apparatus is assembled, so that protection against unscrewing here concerns the period of manufacture during which the coil is not yet mounted.

This braking torque is sufficiently reduced so as to oppose only a negligible resistance when screwing in and locking the screw, so as to provide mechanical holding and electric connection of the conductors placed between the tightening stirrup 9 and the connection portion 7.

In another embodiment using the same principal and shown in FIG. 3, the tongue 19 for locking a screw 20 of a power terminal 21, having the same function as tongue 14, forms part of a terminal cover 17 which is associated with the apparatus 18 for fulfilling other functions such as that of protecting the staff against accidental contact with other terminals, or that of providing guidance of conductors such as 22 towards the inlet of terminal 21 by surface 26.

It will be noted that this insulating and removable terminal cover 17 also concerns a second coil terminal 23 similar to terminal 10 and to the screw of which access may be had through an opening 24 whose end has a wall 16' such as mentioned above.

What is claimed is:

1. A connection terminal for an electric apparatus, comprising a conducting part which is associated with an insulating support and which is provided with a tapped hole, and a first screw which passes through a tightening stirrup and which is engaged in said tapped hole, abutment means being provided on said support, above said tapped hole, on which said head comes into abutment in a maximum unscrewed position of the screw, wherein said screw has a length such that, when it is in said maximum unscrewed position, it presents an end portion opposite the head which projects from the tapped hole, and said connection terminal further comprises a transverse resilient tongue secured to said support and extending under said tapped hole so as to engage said end portion when said screw is in said maximum unscrewed position to prevent turning of said screw.

2. The terminal as claimed in claim 1, wherein said tongue belongs to a coil frame of the electromagnet of a contactor and cooperates with a connection terminal of said coil.

3. The terminal as claimed in claim 1, wherein said tongue belongs to a terminal cover which is removably fixed on a contactor body.

4. The terminal as claimed in claim 3, wherein said terminal cover further includes at least one opening giving access to another screw, and a guide surface for guiding an electrical conductor towards an inlet of said first screw.

* * * * *